United States Patent [19]

Nemeth

[11] 4,242,390

[45] Dec. 30, 1980

[54] FLOOR TILE

[75] Inventor: Jozsef Nemeth, Kungälv, Sweden

[73] Assignee: AB Wicanders Korkfabriker, Alvengen, Sweden

[21] Appl. No.: 889,028

[22] Filed: Mar. 22, 1978

[30] Foreign Application Priority Data

Mar. 3, 1977 [SE] Sweden ..... 7703660

[51] Int. Cl.[3] ..... B32B 7/04; E04C 1/30

[52] U.S. Cl. ..... 428/47; D25/80; 52/591; 52/592; 52/594; 52/595; 428/50; 428/53; 428/58; 428/57; 428/60; 428/77; 428/78; 428/189; 428/191; 428/212; 428/220; 428/332; 428/337; 428/339

[58] Field of Search ..... 428/78, 58, 57, 60, 428/77, 50, 47, 53, 189, 191, 212, 220, 332, 339, 337; 52/591, 592, 594, 595; D25/80, 73

[56] References Cited

U.S. PATENT DOCUMENTS

| | | | |
|---|---|---|---|
| 1,995,264 | 3/1935 | Mason | 428/189 |
| 2,008,244 | 7/1935 | Crooks | 52/595 |
| 2,732,597 | 1/1956 | Contratto | 428/54 |
| 2,894,292 | 7/1959 | Gramelspacher | 428/53 |
| 3,010,859 | 11/1961 | Stephens | 428/60 |
| 3,204,380 | 9/1965 | Smith | 52/592 |
| 3,549,471 | 12/1970 | Denton | 428/189 |
| 3,607,590 | 9/1971 | Califano | 428/77 |
| 3,640,191 | 2/1972 | Hendrich | 52/595 |
| 3,902,293 | 9/1975 | Witt | 428/77 |
| 3,919,443 | 11/1975 | Porter | 428/77 |
| 3,953,268 | 4/1976 | Dillon | 428/77 |

FOREIGN PATENT DOCUMENTS

| | | | |
|---|---|---|---|
| 43-3023 | 2/1968 | Japan | 428/58 |

*Primary Examiner*—Ellis P. Robinson

[57] ABSTRACT

Floor tiles are disclosed which comprise a carrier layer and a superimposed floor surface forming layer which is provided with a decorative wear resistant surface. In one embodiment the carrier layer protrudes beyond the floor surface layer on two sides and the floor surface layer protrudes beyond the carrier layer on the other two sides and the floor surface forming layer defines an angular groove and a bevelled tongue to enable adjacent tiles to be interlocked. In an alternative embodiment of the invention the groove and tongue are formed to have different angles.

26 Claims, 10 Drawing Figures

FLOOR TILE

BACKGROUND TO THE INVENTION

The present invention relates to a floor tile, and more particularly to a floor tile adapted to interengage with a corresponding floor tile with a fit of the tongue and groove type. In this specification the words "tongue and groove type" are used in a broad sense and merely indicate that the tiles are provided with interengaging profiles at their side edges.

Many different types of floor tile have been proposed before, and in particular floor tiles comprising laminates of different layers have been proposed. One proposed floor tile comprises a supporting base plate or carrier layer which carries a floor surface forming layer. The carrier layer comprises, for example, a rectangular plate formed of laminated wood or plywood, and the floor surface forming layer comprises a decorative layer such as varnished parquet blocks.

To facilitate the laying of such prior proposed floor tiles various types of tongue and groove arrangements have been utilised. Tiles with such tongue and groove arrangements are becoming increasingly popular since they have the advantage that they are easy to lay, and thus it is not necessary to utilise trained personnel to lay such floor tiles.

However, prior proposed floor tiles have suffered from disadvantages. If the floor surface forming layer of the floor tile is to be both decorative and, at the same time, resistant to wear, the decorative layer must be of considerable thickness. From the economic point of view this limits the choice of materials available. Furthermore, only hard materials, such as hard woods, may be used if permanent marking is to be avoided at points where the floor is subjected to a high load, for example if the floors are walked on by persons wearing pointed high heels.

A further disadvantage experienced with prior proposed floor tiles is that it is not easy to lay such tiles with only very narrow joints between the adjacent tiles. It is to be appreciated that it is desirable to be able to lay tiles with only narrow joints between adjacent tiles both for the sake of the appearance of the tiled floor, and with regard to hygienic considerations. Of course, it must be borne in mind that the joint itself must be relatively strong so that the joint is not damaged if the joint itself is subjected to point loading.

Where a tiled floor is to be laid on a concrete foundation it has been proposed that the tiles should be laid on a waterproof diffusion barrier. Such a barrier may comprise overlapping layers of asphaltic felt which has cork fragments baked into the asphalt layer so that the tiled floor exhibits a certain resilience. However, even with this expedient, the moisture content of the tiles varies at different times of the year causing the tiles to expand and shrink. Consequently the tiles are therefore normally glued together in the region of the tongue and groove joint to prevent the joints between adjacent tiles expanding and contracting. However, with prior proposed tongue and groove joints it has been found difficult to perform such a glueing step in a satisfactory manner. It has been found that glue often exudes up between the floor tiles and collects on the upper surface of the floor tiles. This is quite unacceptable if the floor tiles are surface treated during manufacture so that, when laid, the surface tiles have a perfect finish, or when the decorative layer is too thin to permit grinding of the floor after the glueing process.

OBJECTS OF THE INVENTION

The present invention seeks to provide floor tiles in which the above described disadvantages and drawbacks are obviated or reduced.

In particular the invention seeks to provide a floor tile which is economic to manufacture, and yet which is easy to lay, and which can be laid to provide a very narrow joint.

SUMMARY OF THE INVENTION

According to one aspect of this invention there is provided a floor tile comprising a carrier layer and a floor surface forming layer, the floor surface forming layer being superimposed on top of the carrier layer, the carrier layer protruding beyond the floor surface forming layer over one part of the periphery of the tile, and the floor surface layer protruding beyond the carrier layer over the other part of the periphery of the tile, the side edge of the floor surface forming layer in said one part of the periphery of the tile being shaped to define an angular groove between the floor surface forming layer and the carrier layer, and the side edge of the floor surface forming layer in the other part of the periphery of the tile being provided with a bevelled angular projection, the tile being adapted to be inter-engaged with one or more corresponding tiles.

Preferably the tile is square or rectangular, having two pairs of mutually parallel sides, the sides of one pair being at right angles to the sides of the other pair. Preferably the said one part of the periphery of the tile comprises two adjacent sides, and said other part of the periphery of the tile comprises the other two adjacent sides.

The floor surface forming layer may comprise a decorative layer, or a wear resistant layer, or preferably a decorative layer in combination with a wear resistant layer.

Preferably the extent to which the carrier layer protrudes beyond the floor surface forming layer in said one part of the periphery of the tile is greater than the extent to which the floor surface forming layer protrudes beyond the carrier layer in said other part of the periphery of the tile.

Conveniently said angular groove is defined in a region of the floor surface forming layer which is adjacent the carrier layer and said angular projection is formed in a region of the carrier layer remote from the floor surface forming layer. Thus, when the tile is horizontal, the angular groove is formed in the lowermost region of the floor surface forming layer, and the angular projection is formed in the lowermost region of the carrier layer.

Preferably the carrier layer is formed of masonite or plywood, and preferably a moisture barrier formed of a plastics material, such as a plastics foil or a plastics coating, is provided on the surface of the carrier layer which is remote from the floor surface forming layer.

The decorative layer may be formed of wood veneer, cork veneer or a textile and the thickness of the decorative layer is preferably in the range of 0.1 to 2.5 mm, most conveniently within the range 0.5 to 0.7 mm.

The wear resistant layer may comprise a durable plastics material, such as polyvinyl chloride, polyurethane or polyester. The wear resistant layer may have a thickness of 0.1 to 2.5 mm, preferably 0.3 to 0.5 mm.

In preferred embodiments of the invention a resilient layer, such as cork, is provided between the carrier layer and the floor surface forming layer.

According to another aspect of this invention there is provided a floor tile comprising an element with a side edge defining the periphery thereof, the side edge, in one part of the periphery, defining an acute angled groove, and, in the remaining part of the periphery, defining an acute angled tongue adapted to be inserted into the groove of a corresponding floor tile, the angle of the groove being less than the angle of the tongue.

When two tiles in accordance with this aspect of the invention are joined together a gap is defined between the tiles which can accommodate glue between the tiles, the gap being largest adjacent the bottom of the groove. This design serves to minimise the amount of glue exuding from between the tiles.

Preferably a tile in accordance with the invention is square or rectangular, having two pairs of mutually parallel sides, the sides of one pair being at right angles to the sides of the other pair, and said one part of the periphery of the tile preferably comprises two adjacent sides and the other part of the periphery comprises the other two adjacent sides.

In a preferred embodiment of the invention the difference between the angle of the tongue and the angle of the groove is less than 10°, and preferably the angle difference is between 2° and 4°. In the most preferred embodiment of the invention the angle of the groove is 30° plus or minus 1° and the angle of the tongue is 32° plus or minus 1°. This provides a good fit and permits for manufacturing tolerances.

Preferably the side of the groove and the side of the tongue closest to the lower side of the tile are in planes parallel with the lower side of the tile. This simplifies manufacture of the tile.

When a floor tile in accordance with the invention is horizontal it is preferable that each side edge defines, in addition to said tongue and said groove, a first vertical planar stop region adapted to abut a corresponding region on a corresponding tile. Preferably the depth of the groove, measured horizontally from the adjacent vertical planar stop region is greater than the width of the tongue, measured horizontally from the adjacent vertical planar stop region. When two tiles are abutted against one another, the tongue is thus prevented from reaching the bottom of the groove, and a good fit is obtained with a tight contact between the vertical surfaces, and thus the risk of glue exuding upwardly is minimised. The difference between the depth of the groove and the width of the tongue is preferably about 1 mm, to provide a suitably dimensioned glue reservoir within the joint. Preferably each side edge of the tile also defines an additional planar stop region disposed in a region between the tongue or the groove and the lower surface of the tile, each first planar region being located between the tip of the tongue or base of the groove and the said additional planar region of the respective side edge. This serves to increase the strength of the joint between two floor tiles.

To prevent the risk of the said additional vertical planar stop regions coming into contact with each other, due, for example, to manufacturing tolerances, while the first surfaces are still separated by a gap it is advisable that the distance between said first and additional planar regions on sides provided with a tongue be greater than the distance between said first and additional planar regions on sides provided with a groove. Preferably the difference in said distances is approximately 3 mm. It has been found to be advisable for a distance between said first and additional planar regions on sides provided with a groove to be approximately 25 mm. This gives a correctly laid joint between adjacent tiles sufficient strength that the joint is not broken or damaged if the joint is subsequently subjected to point loading.

Preferably each of the first planar surfaces and each of the additional planar surfaces is provided with a layer adapted to act as a moisture barrier. This prevents moisture from penetrating into the floor tile through the side edges of the floor tile. It is to be appreciated that if moisture did penetrate into a floor tile the result would be swelling, especially in the edge zones of the tile, and this swelling would result in the edges of the tile having a tendency to lift. A floor in which the tiles absorb moisture at their side edges and swell is not aesthetically attractive, and serious damage to the floor tiles may occur.

The layer acting as a moisture barrier may consist of one or more solidified natural water insoluble and water-repellent waxes and/or solidified water insoluble and water-repellent thermoplastics material. For example the wax may comprise a solidified mixture of one part by weight ethylene vinyl acetate copolymer and about four parts by weight ozocerite wax. Alternatively the layer acting as a moisture barrier may comprise a dried layer of varnish, such as a varnish consisting of vinyl chloride vinyl acetate copolymer, or even a thermosetting resin, such as polyurethane. The thickness of each moisture barrier layer is preferably in the range 0.01 mm to 0.1 mm.

One floor tile in accordance with the present invention comprises a carrier layer and a decorative floor surface forming layer superimposed thereon, the said groove and tongue being formed in the carrier layer. This is advisable from the manufacturing and strength point of view, and also provides increased safety against glue exuding up through the joint between two adjacent floor tiles.

From an economic point of view it is convenient for the carrier layer to be formed of cellulose fibre, in which case it is preferably provided on its lower surface with a moisture barrier in the form of a plastics material foil or plastics material coating. However, the carrier layer is preferably formed of hardboard, plywood, chipboard or the like and its thickness should preferably be between about 6 mm and about 10 mm. In such an embodiment of the invention the decorative layer may consist of wood veneer, cork veneer, textile or the like and may have a thickness in the range of 0.1 to 2.5 mm, preferably in the range 0.5 to 0.7 mm. Preferably a wear resistant layer is superimposed on the decorative layer, the wear resistant layer comprising a durable plastics material such as polyvinyl chloride, polyurethane or polyester, having a thickness in the range of 0.1 to 2.5 mm, preferably in the range of 0.3 to 0.5 mm. The use of a special wear resistant layer enables an extremely thin decorative veneer to be used, thus substantially reducing manufacturing costs.

In order to distribute loads which are applied to the floor by means of elastomeric deformation, so that such loading of the floor does not cause permanent damage to the floor, or does not mark the decorative layer, especially if the decorative layer comprises a veneer of soft wood such as pine, it is preferably to provide a layer of elastomeric material, such as cork, between the carrier layer and the floor surface forming layer.

BRIEF INTRODUCTION TO THE DRAWINGS

In order that the invention may be more readily understood, and so that further features thereof may be appreciated, the invention will now be described by way of example with reference to the accompanying drawings in which:

FIG. 1 is a perspective view from the front and above of one floor tile in accordance with the present invention, FIG. 2 is a view of the tile of FIG. 1 from beneath and the rear, FIG. 3 is a side elevational view of the tile shown in FIG. 1, FIG. 4 is a sectional view illustrating the tongue and groove joint between two adjacent floor tiles as illustrated in FIG. 1, FIG. 5 is a perspective view from above of a second embodiment of a tile in accordance with the invention, FIG. 6 is a side elevational view of the tile illustrated in FIG. 5, FIG. 7 is a cross-sectional view on an enlarged scale of part of the tile illustrated in FIGS. 5 and 6, FIG. 8 is a cross-sectional view on an enlarged scale of another part of a tile as illustrated in FIGS. 5 and 6, FIG. 9 is a cross-sectional view on an enlarged scale of a joint between two tiles as illustrated in FIGS. 5 and 6, and FIG. 10 is a cross-sectional view on an enlarged scale through a central region of another embodiment of a tile in accordance with the present invention.

DETAILED DESCRIPTION OF THE INVENTION

Figure 1:
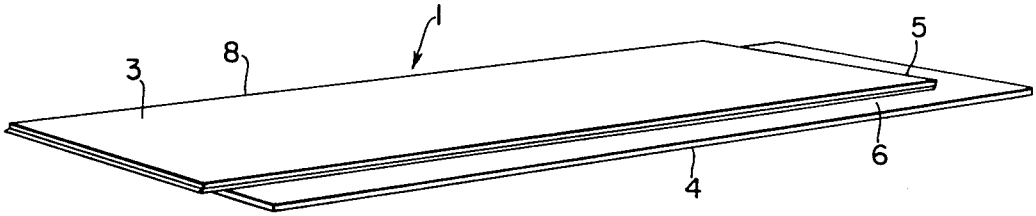
Figure 2:
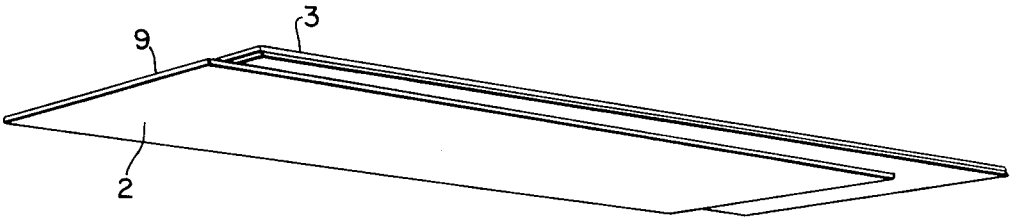

Referring to FIGS. 1 to 4 a floor tile 1 is illustrated which is of generally rectangular shape. Thus the floor tile has two opposed pairs of side edges, the side edges of one pair being at right angles to the side edges of the other pair. The floor tile 1 comprises a carrier layer 2 which is in the form of a rectangular panel or board of masonite, plywood, or some other suitable material, and a floor surface forming layer 3 which is located on top of the carrier layer 2. The floor surface forming layer 3 may be decorative, and is preferably wear resistant. The decorative layer 3 may consist, for example, of wood veneer, cork veneer, textile or some other suitable material and has a thickness of from 0.1 mm to 2.5 mm. Preferably the thickness of the decorative layer is in the range 0.5 to 0.7 mm. A wear resistant surface is applied on top of the decorative layer, the wear resistant surface consisting, for example, of a durable plastics material such as polyvinyl chloride, polyurethane or polyester, the wear resistant surface having a thickness of 0.1 to 2.5 mm, and preferably have a thickness of 0.3 to 0.5 mm. Since this wear resistant surface is provided an extremely thin layer of decorative veneer may be used, thus minimising manufacturing costs.

In a preferred embodiment of the invention a layer of a resilient material, for example, cork, may be provided between the carrier layer 2 and the floor surface forming layer 3. The resilient layer distributes any load applied to the floor by elastic deformation, thus preventing the floor being damaged by a point loading.

Along one long side 4 and one short side 5 of the tile the carrier layer 2 protrudes beyond beyond the floor surface forming layer 3, thus defining a recess. The edge of the floor surface forming layer 3 that defines the base of this recess 6 is provided with an angular undercut recess 7 which is shown most clearly in FIG. 4. The recess 7 is provided in the region of the floor surface forming layer 3 that is immediately adjacent the carrier layer 2, and is thus formed in the lower region of the floor surface forming layer when the tile is disposed horizontally. A vertical portion of the side edge of the floor surface forming layer 3 remains above the undercut groove 7. On the opposite long side 8 and short side 9 of the tile the floor surface forming layer 3 protrudes beyond the carrier layer 2, thus forming a recess 10 which corresponds to the recess 6. The free edge of the floor surface forming layer 3 is provided with a bevelled tongue 11. The bevelled tongue 11 is provided in the lower region of the floor surface forming layer 3 when the tile is horizontal, and above the bevelled tongue 11 is a vertical planar surface.

Figure 3:
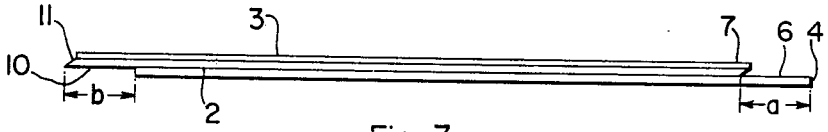

In order to ensure a satisfactory joint between two adjacent tiles the width a of the recess 6, as shown in FIG. 3, may be slightly less than the width b of the recess 10 as shown in FIG. 3.

Figure 4:
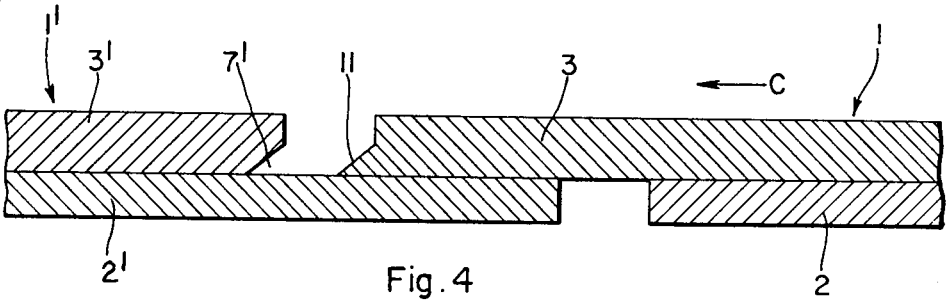
Figure 5:
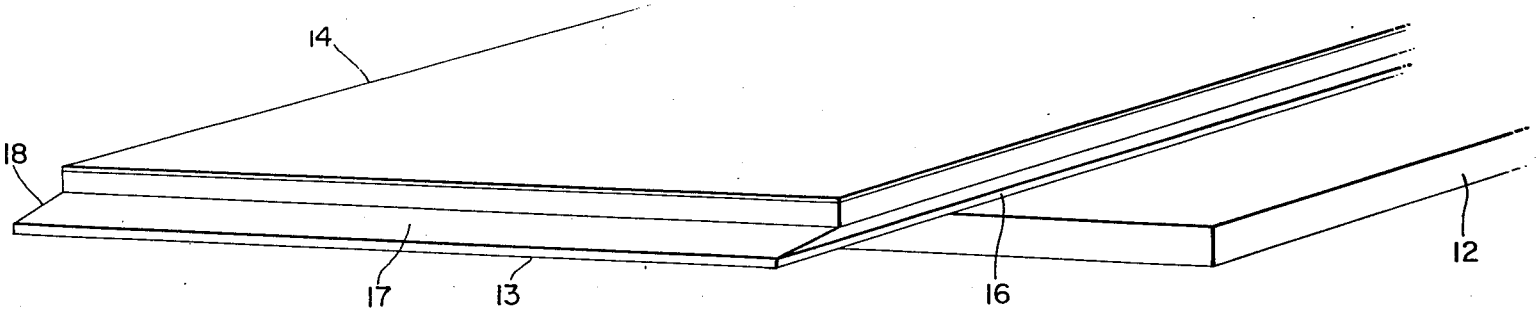

FIG. 4, as mentioned above, illustrates two floor tiles being fitted together. The floor tile 1 is moved in the direction of the arrow c towards the floor element 1', causing the tongue 11 to enter the groove 7' to form a satisfactory joint. If the tiles are secured in position by adhesive located underneath the carrier layers it will be appreciated that adhesive will not be able to exude up from the joint between two adjacent tiles.

Referring now to FIGS. 5 to 8 of the accompanying drawings a second embodiment of a tile in accordance with the invention is again a square or rectangular floor tile having three illustrated side edges 12, 13, 14. The side edges 12 and 14 are parallel to one another, and the side edge 13 is parallel to a fourth narrow side, which is not shown. The side edges 12 and 14 are at right angles to the side edge 13, and the side edge (not shown) which is parallel to the side edge 13. One side edge of each pair is provided with a longitudinal acute angled groove, and the other side edge of each pair is provided with a longitudinal acute angled tongue dimensioned to fit within a groove of a corresponding tile. Thus, referring to FIG. 5, the narrow side 12 is provided with an acute angled groove 16, and the narrow sides 13, 14 are provided with acute angled tongues 17 and 18 respectively. The fourth side, not shown, has an acute angled groove. The tongues 17 and 18 meet at one corner of the tile, and the groove 16 meets the groove which is not shown at the diagonally opposite corner of the tile.

Figure 6:
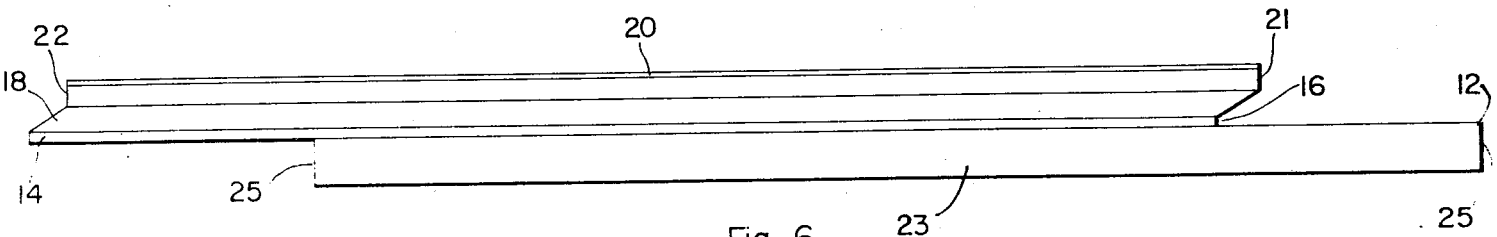

From FIG. 6 it can be seen that each of the narrow side edges 12 and 14 of the first pair is provided with a vertical stop surface 21, 22 respectively, located between the upper surface 20 of the tile and the groove 16 or tongue 18. The vertical surfaces 21, 22 are substantially at right angles to the upper surface 10. Similarly vertical stop surfaces are provided on the other pair of side edges.

Each of the narrow side edges 12, 14 is provided with a second vertical surface, 24 and 25 respectively located between the lower side 23 of the tile and the groove 16 or tongue 18 respectively. The second vertical surfaces 24 and 25 are at right angles with the lower side 13 of the tile. Each of the stop surfaces 21 and 22 is located between the point of the groove or tongue angle and the corresponding second surface 24, 25 respectively of the same side edge.

Figure 7:
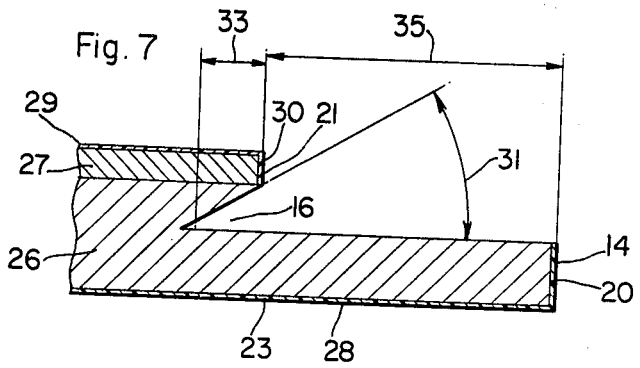
Figure 8:
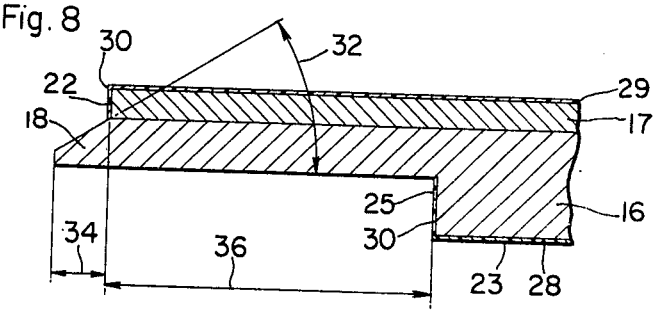

FIGS. 7 and 8 show, on an enlarged scale, respectively a cross-section of a side edge of a tile provided with a groove, and a cross-section of a tile edge provided with a tongue. From these Figures it can be seen that the tile comprises a carrier layer 26 with a decorative layer 27 superimposed thereon. Both the groove 16 and the tongue 18 are formed in their entirety only in the carrier layer 26, and the stop surfaces 21 and 22 extend downwardly from the upper surface of the tile only as far as the upper surface of the carrier layer 26. The carrier layer 26 is composed substantially of cellulose fibre, and is provided, on its lower side with a moisture barrier 28 in the form of a plastics material sheet or coating. This means that if tiles as illustrated in FIGS. 7 and 8 are to be laid on a concrete floor, the concrete need not be covered with diffusion preventive material before the tiles are laid. However, in an alternative embodiment of the invention the carrier layer 26 consists of hardboard, masonite, plywood, chipboard or some similar material, preferably having a thickness of between about 6 mm and about 10 mm.

The decorative layer 27 may consist of wood veneer, cork veneer, textile or the like, and preferably has a thickness from about 0.1 mm up to a few millimeters, for example 2.5 mm. The preferred thickness for a wood veneer is within the range 0.5 mm to 0.7 mm. The upper side of the decorative layer is preferably provided with a protective wear resistant layer 19 which may consist of a durable plastics material such as polyvinyl chloride, polyurethane or polyester sheeting having a thickness of between about 0.1 and about 2.5 mm. The preferred thickness is 0.3 to 0.5 mm. The use of a special wear resistant layer in this manner enables an extremely thin layer of decorative veneer to be used, thus considerably reducing the costs. From FIGS. 7 and 8 it can be seen that the stop surfaces 21 and 22, as well as the second surfaces 24 and 25 are each provided with a layer 30 acting as a moisture proof barrier. The layer 30 comprises a coating agent which has been applied by means of a conventional edge-coating means, and the coating agent may be one which solidifies, dries or cures. Examples of solidifying coating agents are wax mixtures containing natural waxes or thermoplastics, either individually or mixed with each other. A suitable mixture is one comprising one part by weight ethylene vinyl acetate copolymer and about four parts by weight ozocerite wax, the coating agent being suitably kept at a temperature around 170° during the coating process. Other temperatures are to be utilised for different wax mixtures, but the temperature should generally be between 100° C. and 200° C. A suitable drying coating agent consists of a varnish having a dry content of between 10 and 80 percent. A preferred drying varnish contains a vinyl chloride vinyl acetate copolymer as a filmforming component, and has a dry content of around 15%. As an example of curing coating agents, polyurethane varnish having a dry content of around 50% may be mentioned. The thickness of the layer 20 after solidification, drying or curing should preferably be between about 0.01 mm and about 0.1 mm. If the coating is thicker the joints between the tiles will be less attractive from the aesthetic point of view when the flooring is laid, and if it is thinner it is possible that moisture will enter the tile, and the desired result is difficult to achieve.

Figure 9:
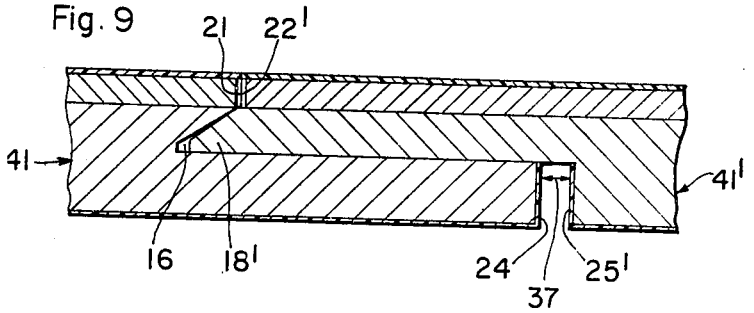

The angle 31 defined by the groove 16 is slightly smaller than the angle 32 defined by the tongue 18. The difference between the angles is at most 10°, and conveniently between about 2° and about 4°. The groove angle 31 is preferably 30° plus or minus 1° and the tongue angle 32 is most preferably 32° plus or minus 1°. In both cases the side of the angle 31 or 32 nearest the lower side 23 of the tile is parallel with the lower side 23 of the tile. As shown in the drawings the bottom of the groove is not pointed but is flat, and the tongue 18 is blunt at the tip. The depth 33 of the groove 16 in the plane of the floor tile below the adjacent stop surface 21 is slightly greater than the width 34 of the tongue 18 that protrudes beyond the adjacent stop surface 22. The difference is preferably about 1 mm and the depth 33 may be about 5 mm while the width 34 may be about 4 mm. Furthermore, a first distance 35 extending, in the plane of the tile, from the stop surface 21 adjacent the groove 16 to the respective second surface 24 is somewhat less than a second distance 36 extending from the stop surface 22 close by the tongue 18 to the relevant second surface 25. The first distance 35 may, for instance, be in the region of 25 mm and the second distance 36 in the region of 28 mm so the difference, i.e. distance 37 (see FIG. 9) is about 3 mm.

When floor units as described above are used to lay a floor glue is applied along the botton of the groove of each tile, after which the tiles are pressed together until the stop surfaces are in abutment. The joint thus formed will then have the appearance as shown in cross-section in FIG. 9. The glue has been omitted in this Figure, however, to give greater clarity. When the stop surfaces 21 and 22' of the floor units 41, 41' respectively are in abutment the second vertical surfaces 24 and 25' are still separated by a gap thanks to the difference between the distances 35 and 36. Also, the tongue 18' does not reach the bottom of groove 16. The glue is thus enclosed in a space between the blunt nose of the tongue 18' and the flat bottom of the groove 16, and in a space extending between the bevelled upper side of the tongue 18' and the upper face defining the groove 16. However, since the vertical surfaces 21, 22' are in abutment the glue cannot readily exude up through the joint between the tiles 41 and 41'. If an extra strong joint is desired the tiles 41, 41' may, of course, be glued together along their horizontal contact surfaces as well, but normally it is sufficient to glue just the groove and tongue joint. However, if desired glue may be located under the tiles, this glue entering into the space between the opposed walls 24, 25'. Thus a strong joint is provided which is resistant to damage.

Figure 10:
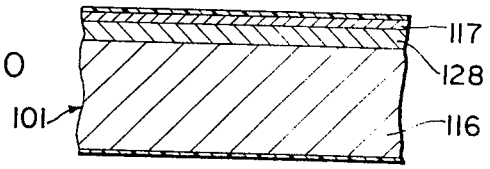

FIG. 10 illustrates a further embodiment of the invention in which the decorative layer 117 of the tile 101 consists of a thin veneer of soft wood. To prevent the soft wood being damaged an intermediate layer 128 of elastomeric or resilient material, such as cork, is provided between the decorative layer 117 and the carrier layer 116. In the event of a high point loading being applied to the floor constituted by such tiles, the intermediate layer 128 would distribute the load by deforming elastomerically. This serves to prevent the occurrence of indentations in the thin, soft veneer.

It is to be appreciated that the invention is not limited to the specific preferred embodiments described above and shown in the drawings. Several variations and modifications are feasible within the scope of the following claims. For example, the angle difference between the bevelled surfaces of the grooves and tongue need not exist over the whole extent of these surfaces, but may only be present over a certain portion of these surfaces.

I claim:

1. A tile for forming a floor wall or the like comprising a generally planar rectilinear member including a carrier layer and a superimposed surface layer; each of said layers having two pairs of mutually parallel side edges, one of said pairs comprising two adjacent side edges; and the other of said pairs comprising the other two side edges; the edges of the carrier layer in one of said pairs being formed with a groove and the corresponding edges of said surface being formed with a vertically square end; the edges of the carrier layer of the other of said pairs being formed with a tongue, the corresponding edge of said surface being formed with a vertically square end; the bottom surface of said groove and tongue being planar and parallel with the lower surface of said rectilinear member, the upper surface of said groove and tongue being slanted with respect to the bottom surface thereof to form an acute angle; the extent of said tongue being less than the depth of said groove, and the angle of the groove being less than the angle of the tongue, whereby the tongue of one tile and the groove of another tile are cooperable to permit penetration of the tongue into the groove to an extent less than the depth thereof, with the square ends of the surface abutting each other to provide a smooth extended surface and said tongue and groove providing a space therebetween for receipt of adhesive, said tongue and groove and abutting floor surface preventing escape of adhesive therefrom.

2. A tile for forming a floor wall or the like comprising a generally planar rectilinear member including a carrier layer and a superimposed surface forming layer of decorative material bonded to its upper surface, each of said layers having two pairs of mutually parallel side edges, one of said pairs comprising two adjacent side edges and the other of said pairs comprising the other two side edges; the edges of one of said pairs of one of said layers being formed with a groove and the corresponding edges of said surface being formed with a vertically square end; the edges of the carrier layer and superimposed layer of the other of said pairs of said one layer being formed with an acute angle tongue, the corresponding edge of said surface being formed with a vertically square end; the bottom surface of said groove and tongue being planar and parallel with the lower surface of said rectilinear member, the upper surface of said groove and tongue being slanted with respect to the bottom surface thereof to form an acute angle, the extent of said tongue being less than the depth of said groove, and the angle of groove being less than the angle of the tongue, whereby the tongue of one tile and the groove of another tile are cooperable to permit penetration of the tongue into the groove to an extent less than the depth thereof, with the square ends of the surface abutting each other to provide a smooth extended surface and said tongue and groove providing a space therebetween for receipt of adhesive, said tongue and grooves and abutting floor surface preventing escape of adhesive therefrom.

3. The tile according to claim 1 or 2 wherein the difference between said two angles is less than 10°.

4. The tile according to claim 1 or 2, wherein the difference between two angles is withint the range 2° to 4°.

5. The tile according to claim 1 or 2, wherein the angle of the groove is 30°±1°, and the angle of the tongue is 32°±1°.

6. The tile according to claim 1 or 2, wherein the member is formed so that the portion of the side edges of said member below the lower side of said groove extends outwardly laterally therefrom, and the portion of the side edges of the member below the lower side of said tongue is recessed inwardly laterally therefrom, each of said portions of said side edges terminating in a wall extending at right angles to the plane of said member.

7. The tile according to claim 1 or 2, wherein the difference between the depth of the groove and the depth of the tongue is about 1 mm.

8. The tile according to claim 1 or 2, wherein each of the stop surfaces is located between the apex of the groove and the apex of the tongue respectively and the wall of the associated side edge.

9. The tile according to claim 6, wherein the length of the extension below said groove is less than the length of the recess below said tongue.

10. The tile according to claim 9, wherein the difference between the length of the extension and of the length of the recess is about 3 cm.

11. The tile according to claim 9, wherein the length of the extension is in the region of 25 mm.

12. The tile according to claim 1 or 2 including seal means on the stop surfaces forming a moisture barrier.

13. The tile according to claim 1 or 2 including seal means on the surfaces of each of said walls forming a moisture barrier.

14. The tile according to claim 12 or 13, wherein the seal means is selected from the group consisting of solidified natural wax, a solidified thermoplastic and a solidified mixture thereof.

15. The tile according to claim 12 or 13, wherein the seal means comprises a solidified mixture of 1 part by weight ethylene vinyl acetate copolymer and about 4 parts by weight ozocerite wax.

16. The tile according to claim 12 or 13, wherein the seal means is a dried layer of varnish.

17. The tile according to claim 12 or 13 wherein the seal means is a vinyl chloride vinyl acetate copolymer.

18. The tile according to claim 12 or 13 wherein the seal means is polyurethane.

19. The tile according to claim 12 or 13 wherein the seal means is a layer having a thickness of at least about 0.01 mm and at most about 0.1 mm.

20. The tile according to claim 1 or 2 wherein said member is composed substantially of cellulose fibre and is provided on its lower surface with a layer of plastic forming a moisture barrier.

21. The tile according to claim 20, wherein the member consists of hardboard, plywood, chipboard or the like.

22. The tile according to claim 2, characterised in that the decorative layer is selected from the group consisting of wood veneer, cork veneer, and textile and has a thickness of at least about 0.1 mm and at most 2.5 mm, suitably between 0.5 mm and 0.7 mm.

23. The tile according to claim 1 or 22, including a wear layer arranged on top of the decorative layer comprising a durable plastic material selected from the group consisting of a PVC, polyurethane or polyester foil having a thickness of at least about 0.1 mm and at most about 2.5 mm.

24. The tile according to claim 23, wherein said wear layer has a thickness between 0.3 mm and 0.5 mm.

25. The tile according to claim 2, including an elastomeric material such as cork arranged between the member and the decorative layer.

26. The tile according to claim 2, wherein said member is between 6–10 mm.

* * * * *